US010934815B2

(12) United States Patent
LaGrange et al.

(10) Patent No.: US 10,934,815 B2
(45) Date of Patent: Mar. 2, 2021

(54) SIGNAL TRANSFER SYSTEM FOR ACTIVATING DOWNHOLE TOOLS AND RELATED METHODS

(71) Applicant: OWEN OIL TOOLS LP, Houston, TX (US)

(72) Inventors: Timothy E. LaGrange, Ponoka (CA); Jeffrey Gartz, Blackfalds (CA); Rockford A. Linville, Springtown, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 132 days.

(21) Appl. No.: 16/153,175

(22) Filed: Oct. 5, 2018

(65) Prior Publication Data

US 2019/0353014 A1 Nov. 21, 2019

Related U.S. Application Data

(60) Provisional application No. 62/674,390, filed on May 21, 2018.

(51) Int. Cl.
*E21B 43/1185* (2006.01)

(52) U.S. Cl.
CPC .... *E21B 43/11852* (2013.01); *E21B 43/1185* (2013.01)

(58) Field of Classification Search
CPC ..... E21B 43/11852; E21B 43/1185; E21B 43/11855; F42D 1/043
See application file for complete search history.

(56) References Cited

U.S. PATENT DOCUMENTS 3,115,932 A * 12/1963 Reynolds ..... E21B 43/025 175/4.52
3,964,454 A 6/1976 Nishimiya
(Continued)

FOREIGN PATENT DOCUMENTS

CA 1301634 C 5/1992
CA 2068230 A1 11/1992

OTHER PUBLICATIONS

Owen Oil Tools, Core Lab, "Differential Safety Firing Assembly," Ball Activated Differential Safety Firing Assembly Low Pressure TC-022-2375-000 R01; pp. 32-34.
(Continued)

*Primary Examiner* — Kipp C Wallace
(74) *Attorney, Agent, or Firm* — Mossman, Kumar & Tyler PC

(57) ABSTRACT

A signal transfer assembly includes a signal transfer propellant assembly and a signal transfer connector tube in hydraulic communication with a signal transfer firing head. The signal transfer propellant assembly has a piston and a gas generating energetic material. The signal transfer connector tube has a bore and a first opening allowing fluid communication between a borehole fluid surrounding the connector tube and the bore. The piston generates a pressure pulse when propelled through the bore by the generated gas. The signal transfer firing head assembly includes a housing having a second opening allowing fluid communication between the housing bore and the borehole fluid. A related method includes forming a well tool by operatively connecting a signal transfer assembly as described above to a primary downhole tool and a secondary downhole tool; conveying the well tool into a wellbore using a work string; and activating the secondary downhole tool by initiating the primary downhole tool.

12 Claims, 7 Drawing Sheets

(56) References Cited

U.S. PATENT DOCUMENTS

| | | | | |
|---|---|---|---|---|
| 4,544,034 | A | 10/1985 | George | |
| 4,612,992 | A * | 9/1986 | Vann | E21B 43/11852 166/297 |
| 4,616,718 | A | 10/1986 | Gambertoglio | |
| 4,836,109 | A | 6/1989 | Wesson et al. | |
| 4,862,964 | A | 9/1989 | George et al. | |
| 4,880,056 | A | 11/1989 | Nelson et al. | |
| 4,969,525 | A | 11/1990 | George et al. | |
| 5,161,616 | A * | 11/1992 | Colla | E21B 43/11852 166/297 |
| 5,191,933 | A | 3/1993 | Edwards et al. | |
| 5,301,755 | A | 4/1994 | George et al. | |
| 5,505,261 | A | 4/1996 | Huber et al. | |
| 5,603,384 | A * | 2/1997 | Bethel | E21B 43/11855 175/4.54 |
| 7,913,603 | B2 | 3/2011 | LaGrange et al. | |
| 8,079,296 | B2 | 12/2011 | Barton et al. | |
| 8,763,507 | B2 | 7/2014 | Ross | |
| 9,540,913 | B2 | 1/2017 | Moore et al. | |
| 9,689,240 | B2 * | 6/2017 | LaGrange | E21B 43/11852 |
| 2006/0196665 | A1 * | 9/2006 | LaGrange | E21B 43/11855 166/298 |
| 2011/0174504 | A1 * | 7/2011 | Wright | E21B 49/081 166/386 |
| 2014/0008069 | A1 * | 1/2014 | Moore | E21B 43/11852 166/297 |
| 2015/0176374 | A1 * | 6/2015 | LaGrange | E21B 43/11852 166/297 |
| 2019/0234189 | A1 * | 8/2019 | Preiss | E21B 23/04 |

OTHER PUBLICATIONS

Owen Oil Tools, Core Lab, Differential Filing Head 3-⅛ inch, TC-025-2375-000; MAN-TC-025(R06), 2009, 2014, pp. 1-12.

* cited by examiner

SIGNAL TRANSFER SYSTEM FOR ACTIVATING DOWNHOLE TOOLS AND RELATED METHODS

CROSS-REFERENCE TO RELATED APPLICATIONS

This application claims priority from U.S. Provisional Application Ser. No. 62/674,390, filed May 21, 2018, the entire disclosure of which is incorporated herein by reference in its entirety.

TECHNICAL FIELD

The present disclosure relates to systems for transferring signals between two or more downhole tools.

BACKGROUND

One of the activities associated with the completion of an oil or gas well is the perforation of a well casing. During this procedure, perforations, such as passages or holes, are formed in the casing of the well to enable fluid communication between the wellbore and the hydrocarbon producing formation that is intersected by the well. These perforations are usually made with a perforating gun loaded with shaped charges. The gun is lowered into the wellbore on electric wireline, slickline, tubing or coiled tubing, or other means until it is at a desired target depth; e.g., adjacent to a hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow from the formation through the perforations and into the production string for flowing to the surface.

Many oil well tools deployed on tubing or coiled tubing use pressure-activated firing heads to initiate a detonation train during a desired well operation. In certain aspects, the present disclosure provides for enhanced signal transfer between two or more well tools, such as adjacent gun sets, for activation of these tools.

SUMMARY

In aspects, the present disclosure provides a signal transfer assembly for activating a downhole tool. The signal transfer assembly includes a signal transfer propellant assembly, a signal transfer connector tube, and a signal transfer firing head. The signal transfer propellant assembly has a piston and a gas generating energetic material. The signal transfer connector tube has a bore in which the piston is disposed and a first opening allowing fluid communication between a borehole fluid surrounding the connector tube and the bore. The piston generates a pressure pulse when propelled through the bore in response to a pressure applied by the generated gas. The signal transfer firing head assembly is in hydraulic communication with the connector tube. The signal transfer firing head assembly includes a housing having a second opening allowing fluid communication between the housing bore and the borehole fluid.

In further aspects, a related method includes the steps of: forming a well tool by operatively connecting a signal transfer assembly as described above to a primary downhole tool and a secondary downhole tool; conveying the well tool into a wellbore using a work string; and activating the secondary downhole tool by initiating the primary downhole tool.

It should be understood that examples certain features of the disclosure have been summarized rather broadly in order that the detailed description thereof that follows may be better understood, and in order that the contributions to the art may be appreciated. There are, of course, additional features of the disclosure that will be described hereinafter and which will in some cases form the subject of the claims appended thereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION

Figure 1A:
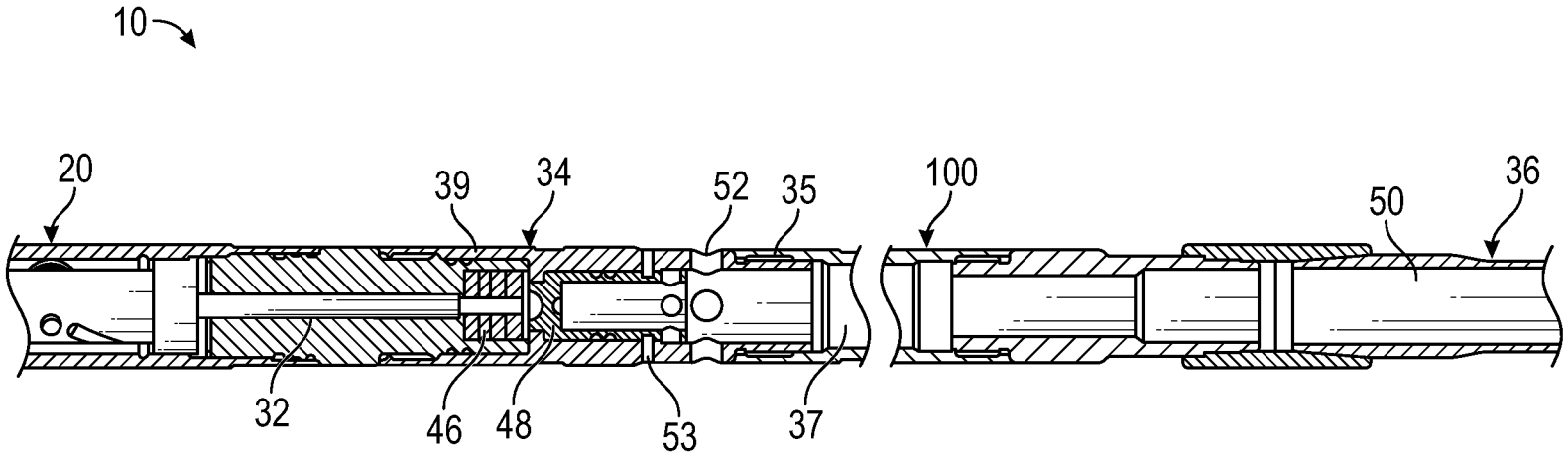
FIGS. 1A-B schematically illustrate a section of a well tool that uses a signal transfer assembly according to one embodiment of the present disclosure.

The present disclosure relates to systems and related methods for transferring signals between two or more downhole tools. The transferred signals may be used to activate one or more of these downhole tools. One downhole tool may be considered a primary downhole tool, which is the downhole tool that initiates a signal transfer upon activation. Another downhole tool may be considered the secondary downhole tool, which is activated upon receiving the signal. Exemplary signals may be in the form of kinetic energy, thermal energy, pressure pulses, etc. Signal transfer systems according to the present disclosure receive a signal at one downhole location and transfer that signal to another downhole location. The present disclosure also relates to firing heads for detonating downhole tools. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Figure 1B:
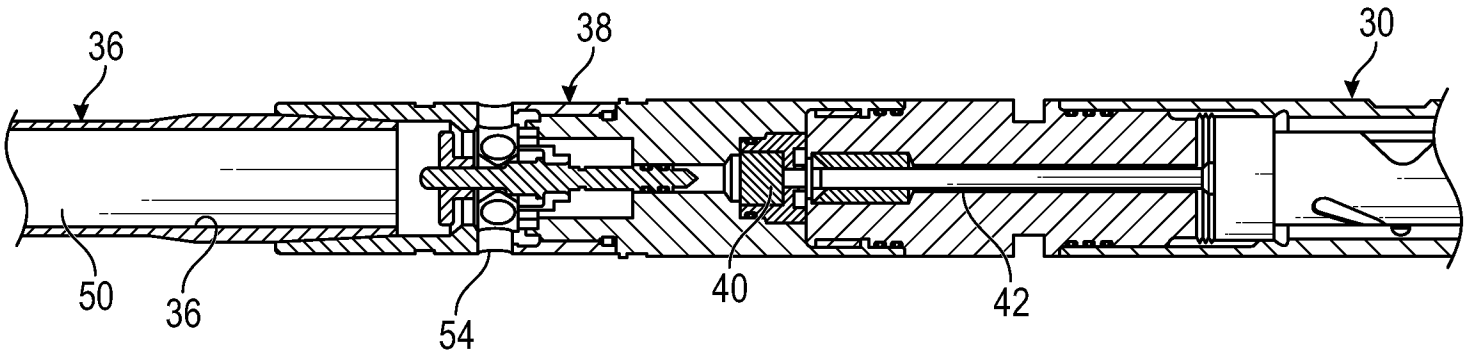

Referring to FIGS. 1A-B, there is shown a well tool 10 having a first perforating gun 20 and a second perforating gun 30. The perforating guns 20, 30 are connected by a signal transfer assembly 100. As discussed in greater detail below, the firing of the first perforating gun 20 initiates a sequence of actions within the signal transfer assembly 100 that causes the firing of the second perforating gun 30. It should be understood that the perforating gun 20 is merely illustrative of an primary downhole tool and the perforating gun 30 is merely illustrative of an secondary downhole tool.

In one embodiment, the signal transfer assembly 100 may include a first detonator cord 32, a propellant assembly 34, a piston chamber sub 35, a connector tube 36, a firing head assembly 38, a detonator 40, and a second detonator cord 42. The detonator cords 32, 42 are formed of conventional energetic material used to detonate shaped charges (not shown). It should be noted that in some arrangements, the detonator cords 32, 42 may be a part of the perforating guns 20, 30. The detonator 40 may be formed of one or more high-explosives, such as RDX (Hexogen, Cyclotrimethylenetrinltramine), HMX (Octogen, Cyclotetramethylenetetranitramine), CLCP, HNS, and PYX. Generally, suitable high-explosives generate a supersonic pressure pulse when detonated.

The propellant assembly 34 may include a propellant charge 46 formed of an energetic material that generates a high-pressure gas upon activation (e.g., deflagration). The gas is of sufficient volume and high pressure to break one or more frangible elements 53 that retain the piston 48 and propel a piston 48 into a bore 37 of the piston chamber sub 35. The piston chamber sub 35 is a tubular member configured to "catch" and retain the piston 48. Suitable materials for propellants may be formed of one or more of ammonium perchlorate, ammonium nitrate, black powder, etc. In contrast, to high-explosives, propellant material is formulated to burn, or "deflagrate," such that the pressure pulse of the generated gas is subsonic.

The bore 50 of the connector tube 36 is in fluid communication with the bore 37 of the piston chamber sub 35 and with wellbore fluids (not shown) surrounding the well tool 10 via ports 52, 54. When in the borehole, wellbore fluids fill the bore 50 and form a liquid column that hydraulically connects the propellant assembly 34 with the firing head assembly 38. Thus, when the piston 48 moves into the bore 37, a pressure pulse is applied via the bore 50 to the firing head assembly 38. Accordingly, the propellant assembly 34 may be considered a fluid mover; e.g., a device configured to displace fluid toward the firing head assembly 38.

Figure 2:
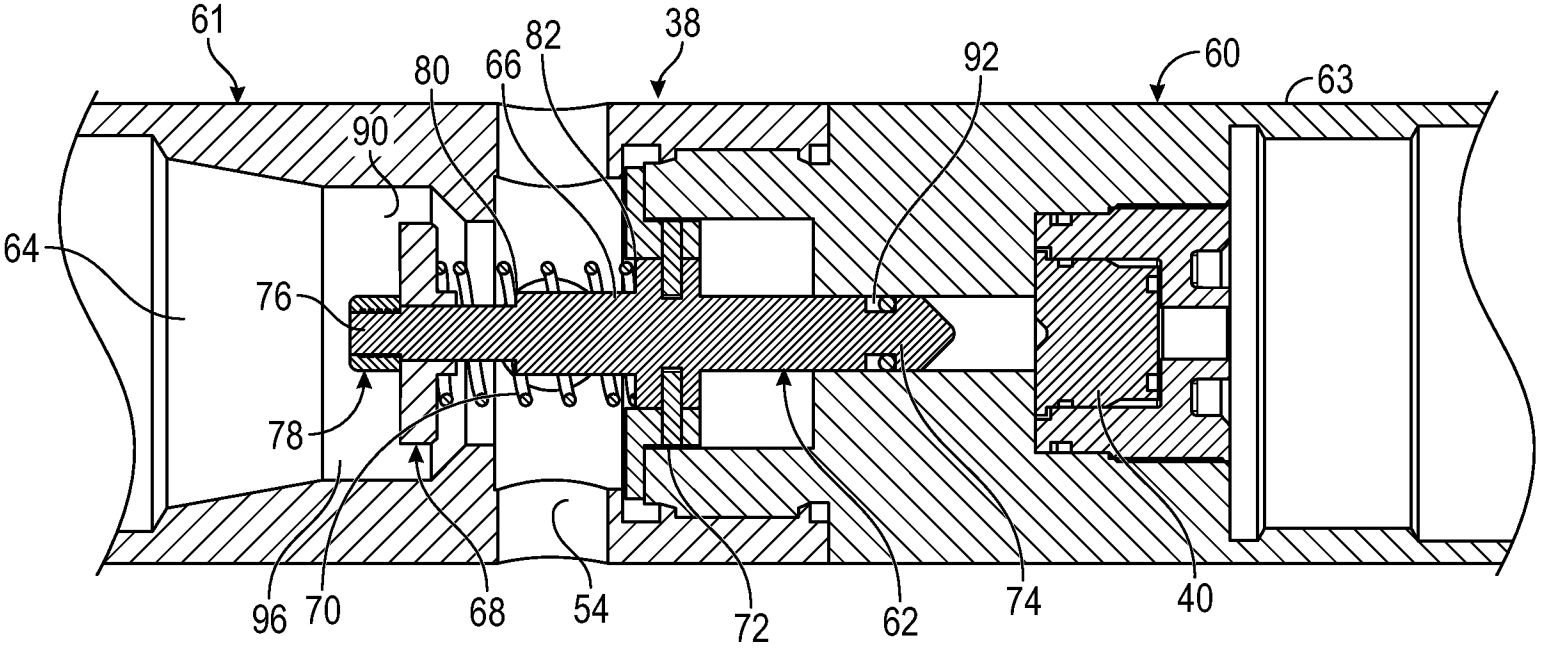
FIG. 2 illustrates a side sectional view of a firing head assembly according to one embodiment of the present disclosure in a pre-activated state.

Referring to FIG. 2, there is shown one non-limiting embodiment of a firing head assembly 38 according to the present disclosure. The firing head assembly 38 may include a housing 60 and a pin assembly 62. The housing 60 may include an upper housing 61 and a lower housing 63. The pin assembly 62 and the detonator 40 are serially disposed, i.e., an "end-to-end" arrangement, in a bore 64 of the housing 60. As described below, the bore 64 includes a plurality of axially and serially aligned bore sections having different geometries and sizes. The serial arrangement enables the transfer of kinetic energy to impact and detonate the detonator 40. In embodiments, the detonator 40 may be configured to provide a time delay. For example, the detonator 40 may deflagrate to provide a flame output that ignites a time delay fuse and/or a power charge for setting tool. A detonator 40 configured with a time delay fuse may provide a time delay between one and twenty minutes. The time delay fuse is formulated to deflagrate or burn for a preset time (e.g., eight minutes) such that the travel of input signal is delayed by the preset time. A detonator 40 configured with a power charge generates a gas of sufficient volume and pressure to stroke or displace a piston head or other structural member.

In one embodiment, the pin assembly 62 includes a shaft 66, a piston head 68, a biasing member 70, and one or more frangible members 72. The shaft 66 may be a solid cylinder having a nose 74, a terminal end 76, and annular first and second shoulders 80, 82. The shoulders 80, 82 may be raised surfaces or projections extending from an outer surface of the shaft 66 that present surfaces that can block axial movement. The axial direction is defined as along the direction the shaft 66 translates. The piston head 68 may be an annular disk shaped body that can slide along the shaft 66 and is retained between a retaining element 78 positioned at the terminal end 76 and the first shoulder 80. The retaining element 78 may be a nut, washer, flange, or other radially enlarged projection formed or attached to the terminal end 76. In some embodiments, the retaining element 78 may be omitted. The biasing member 70, which may be a spring, surrounds the shaft 66 and biases the piston head 68 toward the retaining element 78. In one arrangement, the biasing member 70 is retained between the second shoulder 82 and the piston head 68.

The frangible members 72 may be used to selectively secure the shaft 66 to the outer housing 60. By "selectively," it is meant that the shaft 66 is stationary relative to the outer housing 60, and therefore does not impact the detonator 40 until a predetermined amount of pressure is applied to the pin assembly 62. The frangible members 72 may be bodies such as shear pins that are intentionally constructed to break when subjected to a predetermined loading. The frangible member(s) 72 may also be formed as shoulders, flanges, or other features that connect, either directly or indirectly, the shaft 66 to the housing 60.

Referring to FIGS. 1A-B, and 2, while being conveyed in the wellbore in the pre-activated position, the firing pin shaft 66 is held in place by the frangible member 72. In the pre-activated position, the biasing member 70 pushes the piston head 68 up against the retaining element 78 because there is little or no counter-acting pressure on the piston head 68. The biasing member 70 may be considered to be in an axially expanded state. The piston head 68 is positioned in a first section 96 of the bore 64 that has an inner surface that has an enlarged diameter relative to the outer diameter of the piston head 68, which forms a passage 90 that allows fluids to flow around the piston head 68 in both directions. Thus, whatever pressure differential is present and acts on the piston head 68 cannot overcome the spring force of the biasing member 70. That is, as long as low flow rate conditions are present, fluid can flow in both directions axially around and past the piston head 68. A seal 92 may be used proximate the nose 74 to form a liquid tight-barrier that prevents borehole fluids from contacting the detonator 40. The small force generated by hydrostatic pressure acting on the seal 92 is insufficient to shear the frangible members 72.

Figure 3:
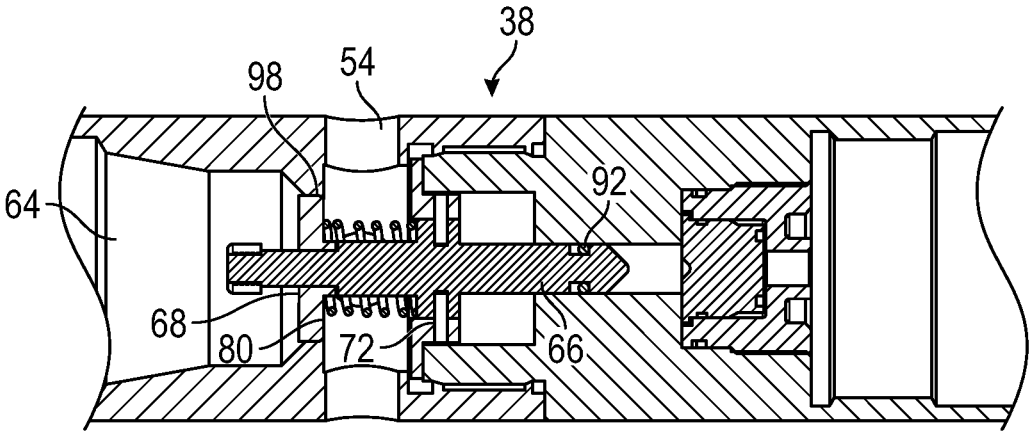
FIG. 3 illustrates a side sectional view of a firing head assembly according to one embodiment of the present disclosure during activation.

Referring to FIGS. 1A-B, and 3, when the detonator cord 32 activates the propellant charge 46, a high-pressure gas is generated. This high-pressure gas breaks the frangible element 53 and pushes the piston 48 into the bore 37, which creates a pressure pulse in the liquid column in the bore 50. When subjected to the pressure pulse in the bore 50, the piston head 68 slides on the shaft 66, which is held stationary by the frangible member(s) 72, until the piston head 68 seats against the first shoulder 80. The pressure pulse acts on a pressure face of the piston head 68 that is generally transverse to the axial direction of movement of the piston head 68. When seated, the piston head 68 is positioned in a second reduced-diameter section 98 of the bore that is sized to minimize flow passages around the piston head 68. Because there is substantially no flow past the piston head 68, the pressure differential across the piston head 68, in addition to the hydrostatic pressure acting on the seal 92, now act on the frangible members 72. However, the pressure pulse has not yet generated enough force to break the frangible members 72. By "substantially no flow," it is meant that flow is sufficiently restricted, or there is sufficient hydraulic isolation between the first bore section 96 and the third bore section 102, to generate the pressure differential required to move the piston head 68. The position of the piston head 68 may be referred to as a partially activated position.

Figure 4:
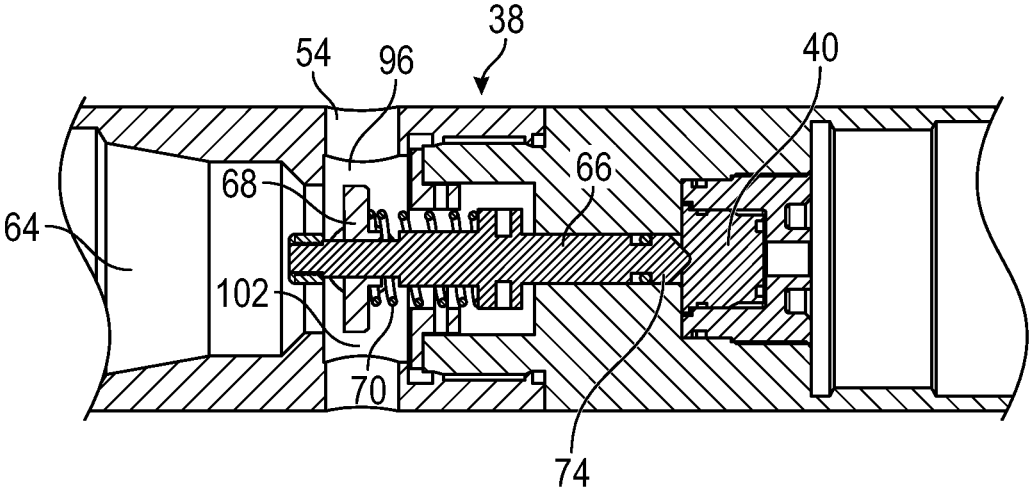
FIG. 4 illustrates a side sectional view of a firing head assembly according to one embodiment of the present disclosure after activation.

Referring to FIGS. 1A-B, and 4, the pressure pulse has reached a magnitude that breaks the frangible members 72 (FIG. 3) and allows the piston head 68 to push the shaft 66 toward the detonator 40, which detonates upon impact of the end 74. The piston head 68 now resides in a third section 102 of the bore 64. The third section 102 is defined by an inner surface that form a flow passage past the piston head 68. The housing opening 54 is formed through the inner surface such that the third section 102 may be considered directly radially inward of the housing opening 54. The position of the piston head 68 may be referred to as a fully activated position. Any pressure above the piston head 68 compresses the biasing member 70 and allows fluid in the bore 64 to vent via the opening 54. The biasing member 70 also applies force to the pin shaft 66 as it travels, which assists with applying impact force to the impact detonator 40.

Figure 5:
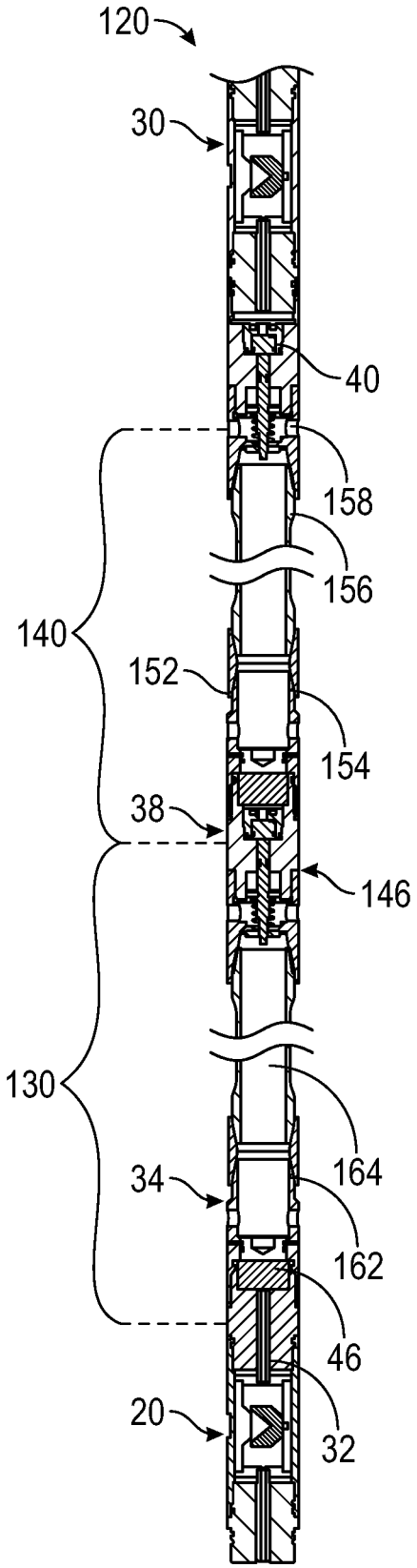
FIG. 5 illustrates a side sectional view of a well tool that uses a repeater assembly and a firing head assembly according to an embodiment of the present disclosure.

Referring now to FIG. 5, there is shown another embodiment of another well tool 120 according to the present disclosure. The well tool 120 has a first perforating gun 20 and a second perforating gun 30. The perforating guns 20, 30 are connected by a repeater assembly 130, and a signal transfer assembly 140. As discussed in greater detail below, the firing of the first perforating gun 20 initiates a sequence of actions within the repeater assembly 130 and the signal transfer assembly 140 that causes the firing of the second perforating gun 30.

The repeater assembly 130 includes a first propellant assembly 160, a first piston chamber sub 162, a first connector tube 164, and a first firing head 146. The signal transfer assembly 140 includes a second propellant assembly 152, a second piston chamber sub 154, a second connector tube 156, and a second firing head 158. The details of these components have already been discussed above.

During use, firing the first perforating gun 20 initiates the detonator cord 32, which activates the first propellant assembly 160 to generate a high-pressure gas. In a manner previously described, this high-pressure gas enables the propellant assembly 160 to create a pressure pulse in the liquid column in the first connector sub 164. Upon encountering the pressure pulse, the first firing head 146 activates the second propellant assembly 152, which creates another pressure pulse in the second connector tube 156. The second firing head 158 responds to this second pressure pulse by activating the detonator 40. The detonator 40 fires the second perforating gun 30 in a conventional manner.

Thus, in the FIG. 5 embodiment, multiple pressure pulses are sequentially generated to transmit a firing signal between two perforating guns. Specifically, the repeater assembly transmits a pressure pulse in response to receiving a pressure pulse. Such an arrangement may be desirable when two perforating guns are separated by a relatively large axial distance. The spatial separation may be too far for one pressure pulse to travel without being dissipated to a point where insufficient energy is available to appropriately displace a firing head. It should be noted that while one repeater assembly is shown in FIG. 5, two or more repeater assemblies may be also be used.

In the FIG. 5 arrangement, the first firing head 146 and the second firing head 158 may be configured as firing heads in accordance with the present disclosure. Alternatively, one or both of the firing heads 146, 158 may use other known pressure actuated firing head configurations. Generally, in order to function with the FIG. 5 repeater arrangement, a suitable firing head includes a sliding pin that can be displaced by a pressure pulse. The sliding pin should have sufficient axial stroke to contact and detonate an adjacent detonator.

Figure 6:
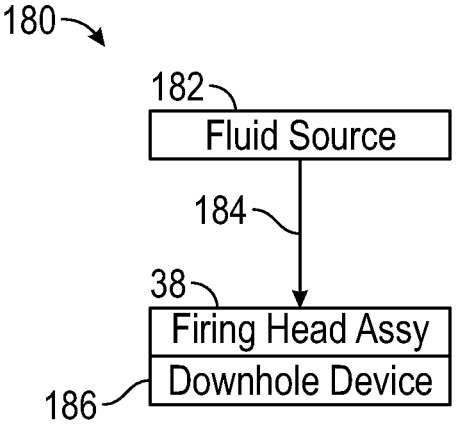
FIG. 6 illustrates a block diagram of a well tool that uses a fluid source, a firing head and downhole device according to an embodiment of the present disclosure.

Referring to FIG. 6, there is shown in functional block diagram of another system 180 according to the present disclosure. The system 180 includes a fluid source 182 and a firing head assembly 38. Referring to FIGS. 3 and 6, as described above, the firing head assembly 38 actuates once a predetermined differential pressure acts on the piston head 68. The fluid source 182 supplies a fluid stream 184 at a flow rate sufficient to generate the predetermined differential pressure to actuate the firing head assembly 38. The fluid source 182 may be a fluid mover positioned in the wellbore or at the surface. For instance, the fluid source 182 may be a surface pump or a downhole pump. In other embodiments, the fluid source 182 may include a pressure source such as compressed gas that moves fluid when released. It should be noted that in such arrangements, the fluid source 182 replaces the propellant assembly as the fluid mover.

The firing head assembly 38 may be used to fire a perforating gun as previously described. More generally, the firing head 38 may be used to activate any downhole device 186 that can change operating states in response to an impact or pressure pulse. Illustrative devices include, but are not limited to, perforating guns, power charge activated setting tools, and tubing or casing cutters. If a setting tool is run, then the detonator 40 will be replaced or augmented with an igniter.

Figure 7:
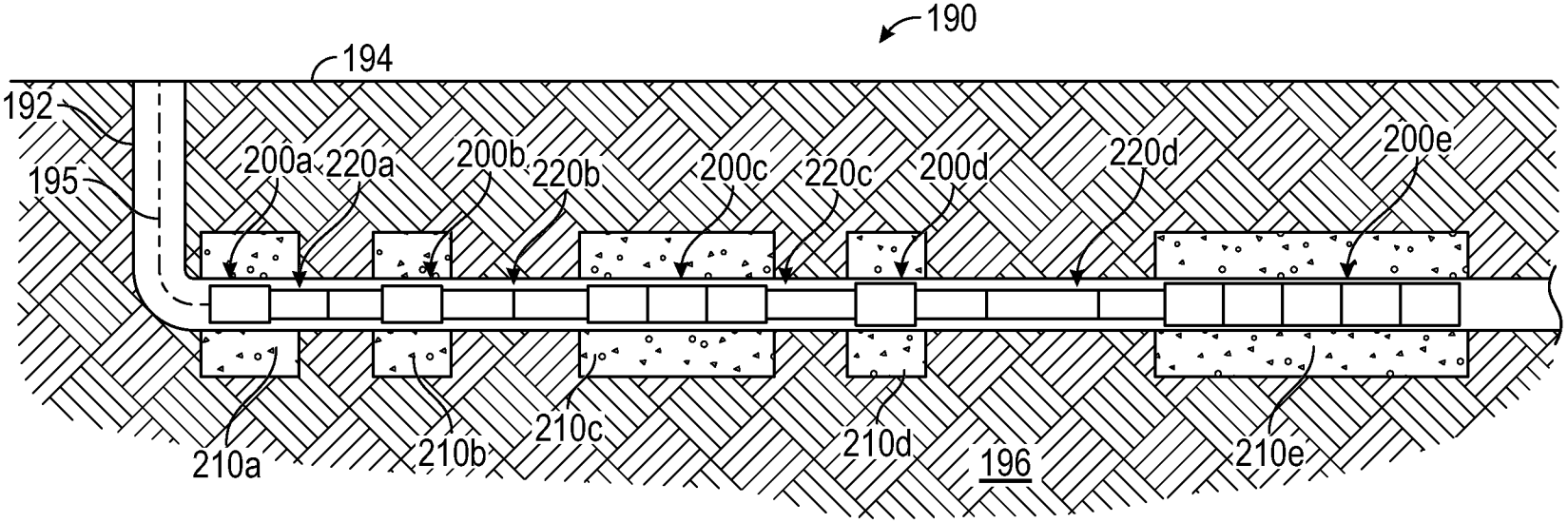
FIG. 7 illustrates a side sectional view of a well tool that uses a plurality of perforating guns, repeater assembly and a firing head assembly according to an embodiment of the present disclosure.

Referring to FIG. 7, there is shown a well perforating system 190 that utilizes the various devices and components described above. The well perforating system 190 is shown in a well 192 formed below a surface 194, which may be a dry land surface or a mud line at a subsea location. The wellbore 192 may be drilled in a formation 196 that has several zones 210*a-e* from which hydrocarbons are to be produced. As illustrated, the zones 210*a-e* may be of different sizes and irregularly spaced apart. Moreover, while five zones are shown, fewer or greater zones may be present and extend across several miles. Embodiments of the present disclosure may be used to perforate all the zones 210*a-e* during one operation, or "trip," into the wellbore 192. Further, the perforations may be formed nearly simultaneously and while the perforating system 190 is stationary relative to the wellbore 192.

In one embodiment, the well perforating system 190 may include perforating gun sets 200*a-e* and detonation transfer assemblies 220*a-d* conveyed by a work string 195. The length of each gun set 200*a-e* is selected to best match the associated zone 210*a-e*. The length of each signal transfer assembly 220*a-d* is selected to position each gun set 200*a-e* at the associated zone 210*a-e*. In the formation illustrated, detonation transfer assemblies 220*a* and 220*b* each have two repeater units because of the distances separating formations 210*a,b,c*. The distance separating formation 210*c* and 210*d* is relatively shorter. Therefore, the signal transfer assembly 220*c* has only one repeater unit. The distance separating formation 210*d* and 210*e* is the longest and requires the signal transfer assembly 220*d* to have three repeater units.

The work string 195 may be coiled tubing or drill pipe. In other arrangements, the work string 195 may be electric wireline, slickline, or other rigid or non-rigid carriers.

In an exemplary use, the formation traversed by the wellbore 192 is logged to determine the location of each of the zones 210*a-e*. Conventionally, the locations are with reference to the "measured depth," which the distance along the wellbore 192. Thereafter, the perforating system 190 is assembled to position each of the perforating gun sets 200*a-e* at an associated zone 210*a-e*. Next, the perforating assembly 190 is conveyed into the wellbore and positioned using the information acquired from the prior logging and information being acquired while conveying. Referring to FIGS. 1A-B and 3, and 7, at this time, wellbore fluid flows via the ports 52, 54 into the bore 50 of the connector tube 36 and the interior of the firing head assembly 38. Thus, a liquid column hydraulically connects the propellant assembly 34 to the firing head assembly 38.

Once properly positioned, a firing signal is sent to detonate the first perforating gun 200*a*. The firing of the first perforating gun 200*a* is transmitted via the first detonation transfer unit 220*a* to the second gun set 200*b*. The firing of the second gun set 200*b* is transmitted via the second detonation transfer unit 220*b* to the third gun set 200*c*. The firing signals are conveyed in this manner until the final gun set 200*e* is fired. It should be appreciated that the formations 210*a-e* have all been perforated at the same time and while the perforating system 190 is stationary in the wellbore 192. If present, time delay fuses would have inserted delays between the firings. Thereafter, the entire perforating system 190 may be retrieved from the wellbore 192.

It should be understood that the well perforating system 190 is merely illustrative of the well tools and systems that may be used in connection with the teachings of the present disclosure. That is, the systems and methods of the present disclosure may be used with any well tool that includes a primary downhole tool and one or more secondary downhole tools. As used in this disclosure, "secondary" means activation occurs only after a "primary" tool has been activated. "Secondary" is not used as a numerical value, but an indicator of the sequence in which activation occurs.

Figure 8:
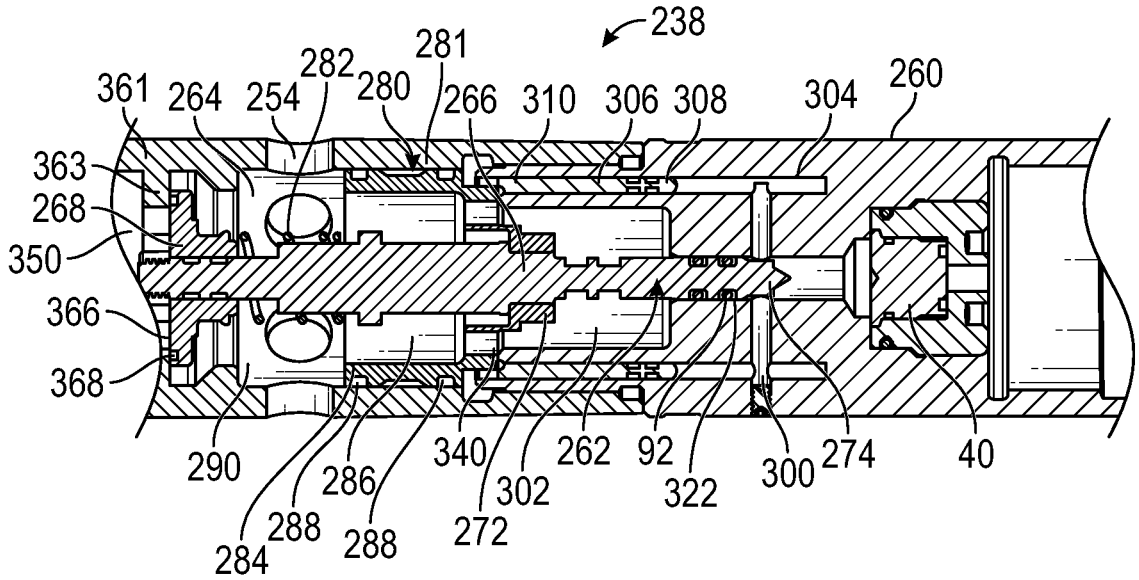
FIG. 8 illustrates a side sectional view of another firing head assembly according to one embodiment of the present disclosure in a pre-activated state.

Referring to FIG. 8, there is shown another non-limiting embodiment of a firing head assembly 238 according to the present disclosure. The FIG. 8 embodiment is, in certain aspects, similar to the FIG. 2 embodiment in the following aspects. The firing head assembly 238 may include a housing 260 and a pin assembly 262. The pin assembly 262 and a detonator 40 are serially disposed, i.e., an "end-to-end" arrangement, in a bore 264 of the housing 260. The serial arrangement enables the transfer of kinetic energy to impact and detonate the detonator 40. The pin assembly 262 includes a shaft 266, a piston head 268, a biasing member 282, and one or more frangible members 272. The shaft 266 may be a solid cylinder having a nose 274.

Different from the FIG. 2 embodiment, the firing head 238 is configured to selectively seal off an opening 254 in the housing 260 that allows wellbore fluid surrounding the firing head 238 to enter and fill the bore 264 of the housing 260. Also, the seal allows the system 100 to be removed from a live well. The bore 264 is formed of several interconnected bore sections, which are discussed below. In one embodiment, the firing head 238 may include a shifting sleeve 280 that is disposed around a portion of the pin shaft 266.

The shifting sleeve 280 may be a tubular member having an outer circumferential surface 281 and an inner circumferential surface 284 that defines a passage 286. The passage 286 has a sufficiently large diameter to allow the piston head 268 to translate at least partially through the shifting sleeve 280. In a pre-activated position, the frangible member 272 prevents the shaft 266 from sliding axially toward the detonator 40. The frangible member 272 may be a shear flange or other inwardly projecting portion of the shifting sleeve 280. The frangible member 272 may interferingly engage a shoulder 273 formed on the shaft 266 to stop axial movement toward the detonator 40. The outer surface 282 includes sealing members 288.

Figure 9:
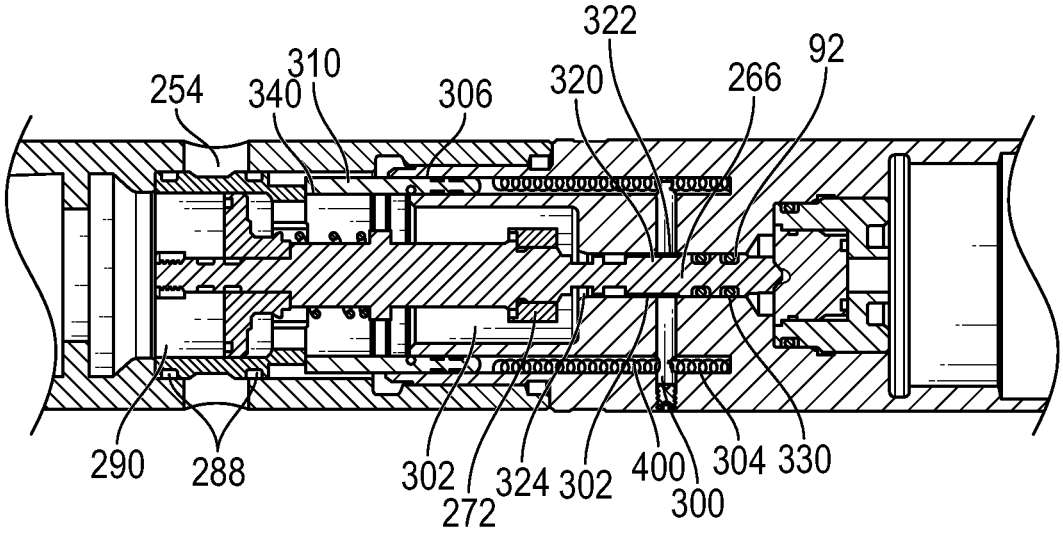
FIG. 9 illustrates a side sectional view of the FIG. 8 firing head assembly after activation.

The sleeve 280 translates within a bore section 290 from a pre-activated position shown in FIG. 8 in which the opening 254 is unblocked to an activated position shown in FIG. 9 wherein the opening 254 is blocked. When the pressure pulse acts on the piston head 268, the frangible member 272 breaks and allows the shaft 266 to travel axially toward the detonator 40. The frangible member 272 may disintegrate or remain as a collar or ring 272 as shown.

The shifting sleeve 280 is displaced from the pre-activated position to the activated position using ambient wellbore fluid pressure. In one embodiment, the housing 260 may include a fluid path 300 that connects a bore section 302 in which the pin shaft 266 slides axially. The fluid path 300 is in fluid communication with one or more passages 304, each of which includes a piston 306. Each piston 306 includes a pressure face 308 in fluid communication with the fluid path 300 via the passage 304 and a contact end 310 for physically contacting the shifting sleeve 280. The pistons 306 translates from a pre-activated position shown in FIG. 8 to an activated position shown in FIG. 9 in their respective passages 304 when sufficient pressure is present in the passage(s) 304.

Referring to FIG. 9, the fluid circuit by which fluid flows to the pistons 306 will be described. The pin shaft 266 includes a reduced diameter section 320 that forms an annular passage 322 defined by an outer surface of the pin shaft 266 and an inner surface of a bore section 324 adjacent to a bore section 302. Thus, fluid in the bore section 302 flows along the annular passage 322 to the fluid path 300. The fluid path 300 communicates the fluid to one or more passages 304. Upon entering the passages 304, the fluid can act on the piston(s) 306.

It should be noted that the seals 92 disposed on the pin shaft 266 provide selective fluid tight sealing for the fluid path 300. As shown in FIG. 8, the seals 92 form a fluid barrier that blocks fluid flow across the annular passage 322. Thus, the fluid path 300 is isolated from ambient borehole pressures. Fluid in the fluid path 300 and the passage(s) 304, which may be air or a hydraulic liquid, may be at or near atmospheric pressure. Pressure at or near atmospheric will be insufficient to overcome the wellbore fluid pressure that is acting on the side of the shifting sleeve 280 that is opposite to the side on which the piston 306 acts. Thus, the shifting sleeve 280 is maintained in the pre-activated position. Referring to FIG. 9, once the pin shaft has been axially displaced, the seals 92 no longer seal the annular passage 322. Instead, the seals 92 form a fluid-tight barrier in an adjacent bore section 330 adjacent to the annular passage 322.

Referring to FIG. 8, in one mode of use, the firing head 238 is conveyed downhole in the illustrated pre-activated position. In this position, wellbore fluid can flow via the opening 254 into the bore 290 and bore section 302. One or more passages 340 in the shifting sleeve 280 may provide a fluid connection between the bore 290 and the bore section 302. As discussed above, the pressure of the fluid in the bore 290 may assist in keeping the shifting sleeve 280 in the pre-activated position, i.e., not blocking the opening 254.

For brevity, the various details of the response of the pin assembly 262 to an applied pressure pulse will not be described as the response is generally similar to that described in connection with the FIG. 2 embodiment. A difference in operation exists after the pin assembly 262 has translated toward and contacted the detonator 40. At this time, high pressure well fluid resides in the bore section 302.

Referring to FIG. 9, the well fluid in the bore section 302 flows through the annular passage 322 and via the fluid path 300 into the passage 304. By acting on the pressure face 308, the fluid pressure axially displaces the piston(s) 306 toward the shifting sleeve 280. The contact end 310 of the piston(s) 306 may contact the shifting sleeve 280 at a shoulder 340 or other suitable contact surface of the shifting sleeve 280. In response to the applied pressure, the shifting sleeve 280 slides along the bore 290 until seated under the opening(s) 254. When seated, the seals 288 may bracket and form fluid barriers that isolate the bore 264 from the openings(s) 254. As should be apparent from the above, the bore 264 include in serial alignment, the bore section 290 that generally include the opening(s) 254, an bore section 302, a bore section 324 that includes the annular passage 322, and a bore section 330 in which the seals 92 may form a seal after activation. In embodiments, a biasing member 400, such as spring, may be positioned in one or more of the passages 304 to assist in pushing the pistons 306 toward the shifting sleeve 280.

Referring to FIG. 8, a seal may also be formed that isolates the bore 264 from fluid communication with an adjacent bore 350, which may be the connector tube bore 50 (FIG. 1B). In one embodiment, an upper housing 361 may include an inwardly projecting annular shoulder 363 that acts as a sealing surface. The piston head 268 may include a contact face 366 on which is disposed an annular sealing member 368. The contact face 366 and the shoulder 363 are generally parallel to one another. Thus, pressing the contact face 266 against the shoulder 363 activates the sealing member 368, which forms a fluid-tight barrier at the contacting surfaces.

In embodiments, the seal at the shoulder 363 is directionally sensitive. The biasing member 282 provides a biasing force that urges the piston head 268 to the shoulder 262. For a seal to be made, the biasing force combined with the fluid pressure in the bore 264 must be greater than the fluid pressure in the adjacent bore 350 in which the annular shoulder 363 is positioned. Specifically, the pressure differential must be sufficiently large to axially displace the piston head 268 toward the shoulder 363 and activate the sealing member 368. If a pressure differential of sufficient magnitude does not exist, then fluid-tight seal may not be formed. Moreover, if the pressure in the adjacent bore 350 is greater than the pressure in the bore 264 in an amount to overcome the biasing force of the biasing member 282, then the piston head 268 is displaced away from the shoulder 363.

Referring to FIGS. 1 and 8, it should be appreciated that the firing head 238 acts as a check valve to provide well control prior to activating the firing head 238. The face seal 368 on piston head 268 ensures that pressure at or downhole of the firing head 238 will not enter the connector 36. However, pressure from uphole of the firing head 238 will push the piston head 268 away from the shoulder 363 and allow fluid to move down the connector 36 and into the firing head 238. If the system 100 is removed from a live well before activation, the piston head 238 provides well control.

In the context of the present disclosure, a detonation is a supersonic combustion reaction. Whereas a burn or deflagration is a subsonic combustion reaction. High explosives (RDX, HMX, etc.) will detonate. Low explosives such as propellant will deflagrate. Therefore, when the propellant burns (deflagrates) it creates a subsonic pressure pulse that may be used to propel the piston and generate a pressure pulse through the tubing to activate the next firing head.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. A signal transfer assembly for activating a downhole tool, comprising:

a signal transfer propellant assembly having a tubular member, a piston disposed in the tubular member, and an energetic material in the tubular member that generates a gas, the energetic material being selected to generate a gas and a subsonic pressure pulse:

a signal transfer connector tube having a bore, the connector tube having a first opening allowing fluid communication between a borehole fluid surrounding the connector tube and the bore upon introduction of the signal transfer assembly into a borehole, the piston configured to generate a pressure pulse when propelled through the bore of the tubular member in response to a pressure applied by the generated gas; and a signal transfer firing head assembly in hydraulic communication with the connector tube, the signal transfer firing head assembly including a housing having a bore and a second opening allowing fluid communication between the housing bore and the borehole fluid.

2. The signal transfer assembly of claim 1, wherein the energetic material is energetically coupled to a detonator cord of a perforating gun.

3. The signal transfer assembly of claim 1, wherein the first opening is at an end of the signal transfer connector tube that is opposite to an end connected to the signal transfer firing head assembly.

4. The signal transfer assembly of claim 1, wherein the signal transfer propellant assembly include a housing having a power chamber in which the gas accumulates, and wherein the piston has a wall having one side in contact with the gas in the power chamber and another side in contact with fluid resident in the bore of the signal transfer connector tube.

5. The signal transfer assembly of claim 1, wherein the signal transfer firing head is energetically coupled to a second perforating gun.

6. The signal transfer assembly of claim 1, wherein the energetic material is energetically coupled to a primary downhole tool and wherein the signal transfer firing head is energetically coupled to a secondary downhole tool.

7. The signal transfer assembly of claim 1, further comprising a repeater assembly that includes:

a repeater propellant assembly configured to be activated by a primary downhole tool;

a piston chamber sub connected to the repeater propellant assembly, the piston chamber sub having a piston displaced by a gas generated by the activated repeater propellant assembly;

a repeater connector tube connected to the piston chamber sub, the piston creating a pressure pulse in the repeater connector tube when displaced by the generated gas; and a repeater firing head configured to activate the signal transfer propellant assembly, and wherein the signal transfer firing head is energetically coupled to a secondary downhole tool.

8. The signal transfer assembly of claim 1, wherein the signal transfer firing head assembly includes:

a shaft having a nose and a terminal end, the shaft including a first shoulder and a second shoulder formed between the nose and the terminal end;

a piston head slidably mounted on the shaft and positioned between a retaining element and the first shoulder; and a biasing member mounted on the shaft and positioned between the piston head and the second shoulder, wherein the shaft, the piston head, and biasing member are disposed in the housing bore.

9. The signal transfer assembly of claim 8, wherein the housing bore has a plurality of serially-aligned bore sections, wherein the plurality of bore sections include a first bore section diametrically larger than the piston head, a second bore section that is diametrically smaller than the first bore section, and a third bore section directly radially inward of the housing opening, the second bore section connecting the first bore section with the third bore section.

10. The signal transfer assembly of claim 9, wherein the piston head hydraulically isolates the first bore section from the third bore section when received in the second bore section.

11. The signal transfer assembly of claim 8, further comprising at least one frangible member connecting the shaft to the housing, wherein the at least one frangible member is configured to break only after the piston head enters the second bore section.

12. A method for activating a downhole tool, comprising:

operatively connecting a signal transfer assembly to a primary downhole tool and a secondary downhole tool, the signal transfer assembly comprising:

a signal transfer propellant assembly having a tubular member, a piston disposed in the tubular member, and an energetic material that generates a gas, the energetic material being selected to generate a subsonic pressure pulse using the generated gas;

a signal transfer connector tube having a bore, the connector tube having a first opening allowing fluid communication between a borehole fluid surrounding the connector tube and the bore upon introduction of the signal transfer assembly into a borehole, the piston configured to generate a pressure pulse when propelled through the bore of the tubular member in response to a pressure applied by the generated gas; and a signal transfer firing head assembly in hydraulic communication with the connector tube, the signal transfer firing head assembly including a housing having a second opening allowing fluid communication between the housing bore and the borehole fluid, conveying the signal transfer assembly, the primary downhole tool, and the secondary downhole tool into a wellbore using a work string; and activating the secondary downhole tool by initiating the primary downhole tool.

* * * * *